United States Patent [19]

Szeliga

[11] 4,354,914

[45] Oct. 19, 1982

[54] MARKING HEAD FOR ELECTROCHEMICAL PROCESS

[75] Inventor: Philip C. Szeliga, Utica, N.Y.

[73] Assignee: Electromark, Div. of Mohawk International Inc., Utica, N.Y.

[21] Appl. No.: 251,380

[22] Filed: Apr. 6, 1981

[51] Int. Cl.[3] ..... C25D 17/14; C25D 21/00; C25B 11/12; G01D 15/10

[52] U.S. Cl. ..... 204/224 R; 204/290 R; 204/294; 204/228; 204/271; 346/76 PH

[58] Field of Search ..... 204/224 R, 294, 271, 204/290 R, 290 F, 129.6, 228; 346/76 PH

[56] References Cited

U.S. PATENT DOCUMENTS

| | | | |
|---|---|---|---|
| 2,486,985 | 11/1949 | Ruderfer | 204/224 R X |
| 3,719,261 | 3/1973 | Heinzer et al. | 346/76 PH X |
| 3,912,368 | 10/1975 | Ponjee et al. | 204/224 R X |

FOREIGN PATENT DOCUMENTS

| | | | |
|---|---|---|---|
| 2728256 | 1/1979 | Fed. Rep. of Germany | 204/224 R |
| 1219733 | 1/1971 | United Kingdom | 204/224 R |
| 418299 | 8/1974 | U.S.S.R. | 204/224 R |
| 724308 | 3/1980 | U.S.S.R. | 204/224 R |

*Primary Examiner*—Donald R. Valentine
*Attorney, Agent, or Firm*—Bruns & Jenney

[57] ABSTRACT

A marking head for use in the electrochemical process wherein a conductive metal part is imaged by firing electrodes against the part in the presence of an electrolyte. The marking face of the head contains an imaging board that includes seven segment digit modules that are capable of being fired in a pre-programmed order whereupon the characters recorded upon the part can be sequenced in a desired order. The segments are printed upon a copper coated board using a photoetching technique which leaves behind a copper coating in the segmented areas. Each segment is then coated with a carbon based material to provide a series of electrodes that can be efficiently operated in the presence of an electrolyte without breaking down.

11 Claims, 9 Drawing Figures

MARKING HEAD FOR ELECTROCHEMICAL PROCESS

BACKGROUND OF THE INVENTION

This invention relates to an improved marking head for use in an electrochemical marking process for imaging conductive metal parts.

In most electrochemical marking processes, a grounded receiving surface is marked or imaged by firing a block-like electrode through a stencil in the presence of a suitable electrolyte. The electrical current passing through the stencil is shaped in accordance with the design cut therein, whereby a latent image of the stencil pattern is recorded upon the receiving surface. Under the combined influence of the electrical charge and the electrolyte an etch is formed upon the receiving surface in conformity with the image pattern and, at the same time, an oxide of the base material is deposited within the etched region to create a dark and clearly discernible mark. Because the electrochemical marking process does not deform or otherwise harm the surface of the receiving part, and because the marking equipment is also clean and easy to operate, this type of imaging process has found widespread use in industry.

It is now the common practice to change stencils every time a part number changes or different information is to be recorded on the receiving part. The cutting of new stencils and replacing them in the marking apparatus is generally a time-consuming and costly procedure. By the same token, when a large number of stencils are to be handled in some type of ordered sequence, the danger of an error occurring is greatly increased. Because the subject marking process creates a permanent mark, mismarked parts ordinarily must be scrapped or extensively reworked in order to render them reusable. In any event, erroneous marking of the parts typically proves to be an expensive proposition for the manufacturer.

SUMMARY OF THE INVENTION

It is therefore an object of the present invention to improve the electrochemical marking process used to record information upon conductive metal parts.

A further object of the present invention is to provide an improved marking head for use in the electrochemical marking process.

A still further object of the present invention is to provide an electrochemical marking head that can be used to record information upon a conductive part without the use of a stencil.

Yet another object of the present invention is to provide a marking head for use in the electrochemical marking process that contains at least one digit module containing a number of electrodes that can be fired in different electrical patterns to image selected characters upon a receiving surface.

A further object of the present invention is to provide a programable marking head for use in an electrochemical marking process.

These and other objects of the present invention are attained by means of a marking head for use in an electrochemical process that includes one or more digit modules which contain a number of electrode segments that can be independently fired in differing patterns whereby selected characters are recorded upon a receiving surface. A copper coated, non-conductive board is photoetched to establish the desired electrode pattern upon the face of the board. The electrode segments are then coated with a thin layer of carbon which will not react with the electrolytes used in the process. Each carbon coated electrode is connected to an electrical terminal that is printed upon the back of the board whereby the electrodes can be programmed to fire in different patterns to record selected information on the imaged surface.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

With further reference to the drawings, wherein like components are indicated by like reference numbers, there is shown an electrochemical marking head 10 and the method of manufacturing the same. The present marking head is suitable for use in an electrochemical marking process wherein metal parts are each provided with a different number. The information recorded by the head can be programed to image numbers in either an ascending or descending order without the need of firing electrodes through a stencil. Although the marking head will be described with specific reference to a plurality of horizontally-aligned modules that are capable of being selectively fired to image numbers from 0 to 999 in a desired sequence, it should be understood that the number of digit modules can be increased or decreased or the electrode segment format used in association with each module changed to accomodate different characters without departing from the teachings of the present invention.

Figure 7:
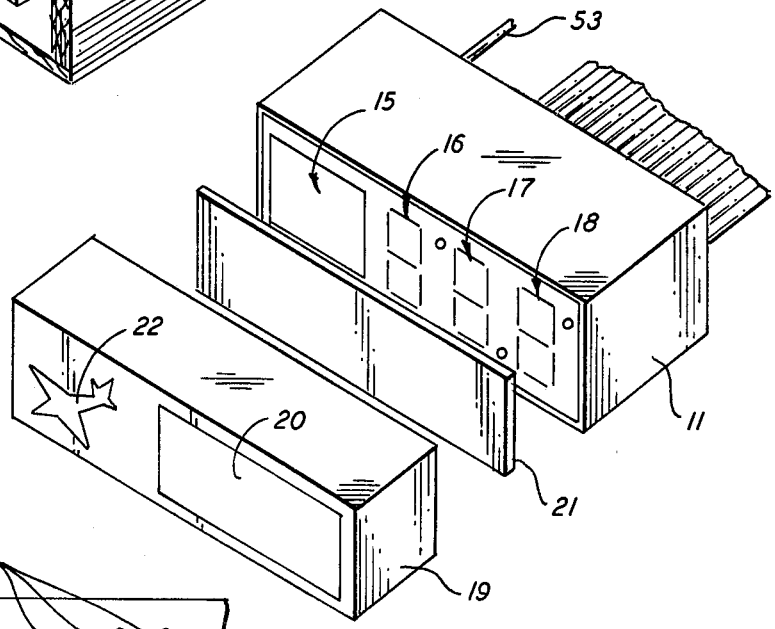
FIG. 7 is a perspective view of a marking head embodying the teachings of the present invention showing the arrangement of the marking segments located on the front face thereof.

As best illustrated in FIG. 7 the marking head 10 of the present invention includes a housing 11 of any suitable construction that is adapted to support an imaging board 12 in the front wall thereof. In assembly, the board contains a number of electrically isolated electrodes thereon which are capable of being brought into contact against the receiving surface of a part to be marked. The electrodes are arranged in a specific format that includes a composing block 15 and three horizontally-aligned digit modules that are generally referenced 16–18. Each module further includes seven elongated electrodes, reference A–G in FIG. 8, that are arranged in a conventional 7 segment display configuration. As in most conventional 7 segment readout systems, the electrodes in each module are capable of being fired independently in a selected pattern to create an electric image of any numeral from 0 through 9. When the electrodes are fired against a grounded conductive metal plate in the presence of a suitable electrolyte, a permanent, nondestructive, clearly discernible, etch is produced in the part.

Although not necessary for the practice of the present invention, the composing block is used to image permanent information upon the receiving surface. As is well known in the electrochemical marking process, a solid electrode such as the composing block can be fired through a stencil to create an image of the pattern that has been cut therein. The stencil is typically in the form of a cap 19 that is slipped over the distal end of the head and secured in place by any suitable means. It should be understood the stencil area underlying the digit modules is cut away to provide a clear window 20 for exposing the digit modules to the receiving surface. A wicking pad 21 is placed between the stencil and the writing face of the marking head to bring the necessary electrolyte into the imaging region. Any desired pattern such as a corporate logo 22 or the like may be cut into the stencil area overlying the composing block so that when the block is fired through the stencil pattern the design is imaged upon the receiving surface.

The electrodes contained in the digit module areas of the marking head can be programed to be fired in any desired combination to record selected information without the aid of a stencil. Elimination of the need for a stencil in the writing region of the head overcomes many troublesome registration and alignment problems which have heretofore caused difficulties in the art.

Figure 1:
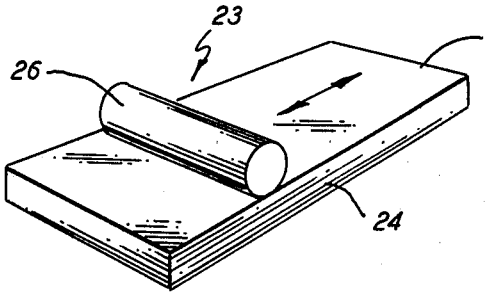
FIGS. 1–5 are perspective views illustrating a series of processing steps for preparing an imaging board that can be programed to generate electrical images of selected characters upon a receiving surface.

Referring more specifically to FIGS. 1–6, the method of fabricating the programable imaging board used in the marking head of the present invention will now be explained in greater detail. The board 23 is formed of a conductive base 24 which is coated on both sides with a thin layer 25 of copper. Initially, the front surface of the board, which in this case is the electrode imaging face, is coated with a thin layer of photosensitive material similar to that used in preparing printed circuit boards. As illustrated in FIG. 1, the photosensitive material is rolled onto the surface to be prepared by roller 26 to establish a uniform, even, coating thereupon.

Figure 2:
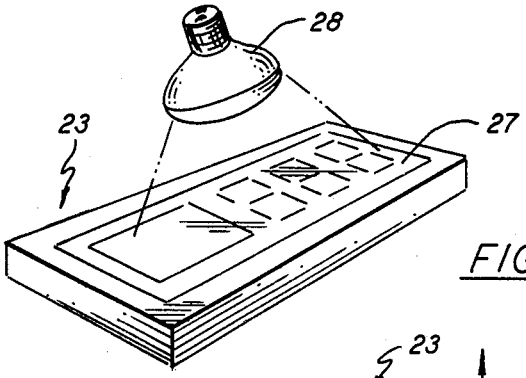
Figure 3:
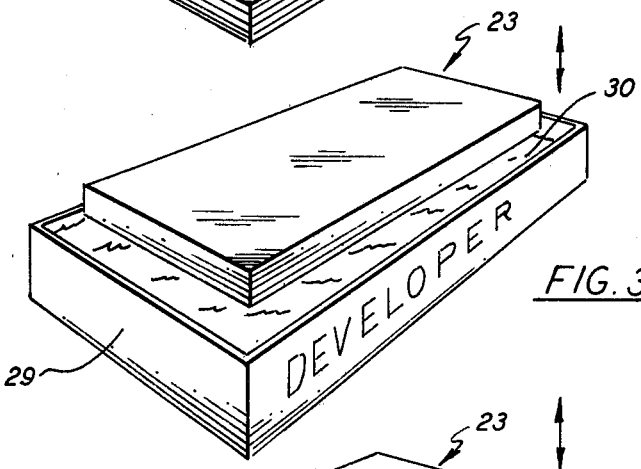

After the board has been coated a film positive 27 bearing the pattern that is to be placed on the writing face of the board is photographically imaged upon the photosensitized surface using techniques that are well known in the printed circuit board art. The film positive is placed in accurate registration over the photosensitive coating as shown in FIG. 2, and the sensitized surface is then subjected to light from a suitable illumination source 28 to expose the surface in the underlying non-imaged regions. The exposed plate is washed in a developer bath 29 or the like as illustrated in FIG. 3. The developer 30 removes the photosensitive material in the non-imaged areas thereby exposing the underlying copper coating.

Figure 4:
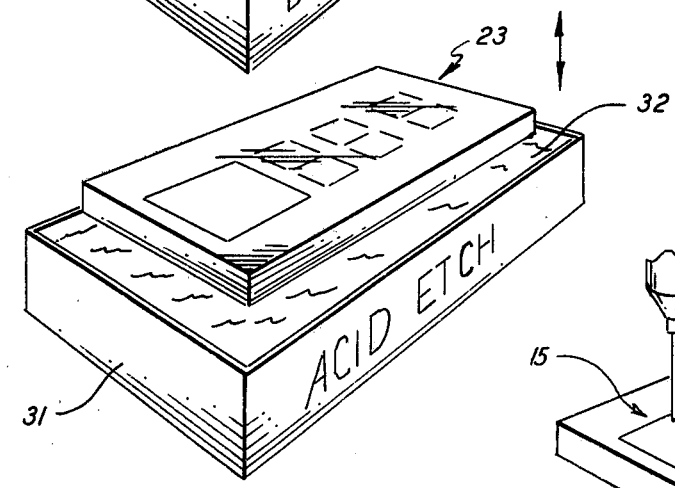

After development, the board is subjected to a second bath 30 containing a suitable acid that is capable of etching away the copper coating in the exposed region as shown in FIG. 4. The board is then washed with water or a neutralizing solution to remove the excess acid and the remaining photosensitive material is removed using any suitable means to reveal the underlying copper pattern.

Figure 9:
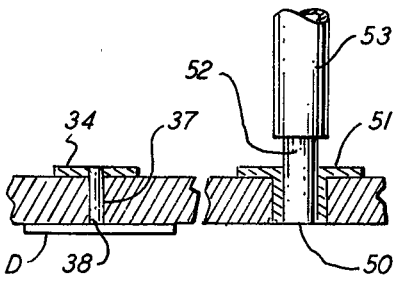
FIG. 9 is a section taken along lines 9—9 in FIG. 8 further illustrating the construction of the board.

In the practice of the present invention both sides of the board are exposed to different patterns. As noted, the front or writing face of the board contains patterns relating to the composing block and the three digit modules. FIG. 9 is an enlarged view depicting a portion of the back face of the board immediately behind the composing block and the first adjacent digit module which is in this case represents the hundreds module. Elongated copper terminals 33—33 are photoetched in the copper coating on the back of the board as explained with reference to FIGS. 1–4. The proximal end of each terminal includes an enlarged circular soldering pad 34 which is situated directly behind one of the copper segments etched upon the face of the board. The elongated terminals are brought out in a parallel alignment toward the top margin 35 of the board. The copper terminals are spaced apart to provide ample room for leads to be soldered or otherwise connected to the distal ends thereof.

Figure 5:
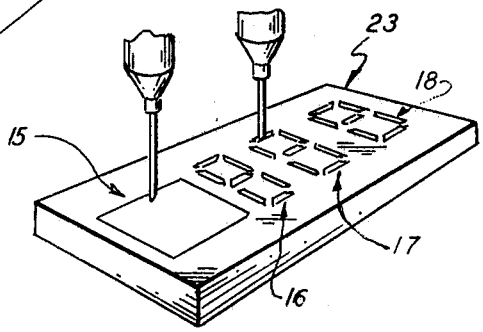

After both sides of the board have been etched to provide the copper electrode segments and the associated terminals, holes are drilled through the board as shown in FIG. 5 to establish passages 37 (FIG. 9) between the individual electrode segments and the soldering pads of the associated terminals. The passages are filled with a solder core 38 to provide an electrical connection therebetween. Drilling of the required holes can be accomplished using any suitable drilling means.

Figure 6:
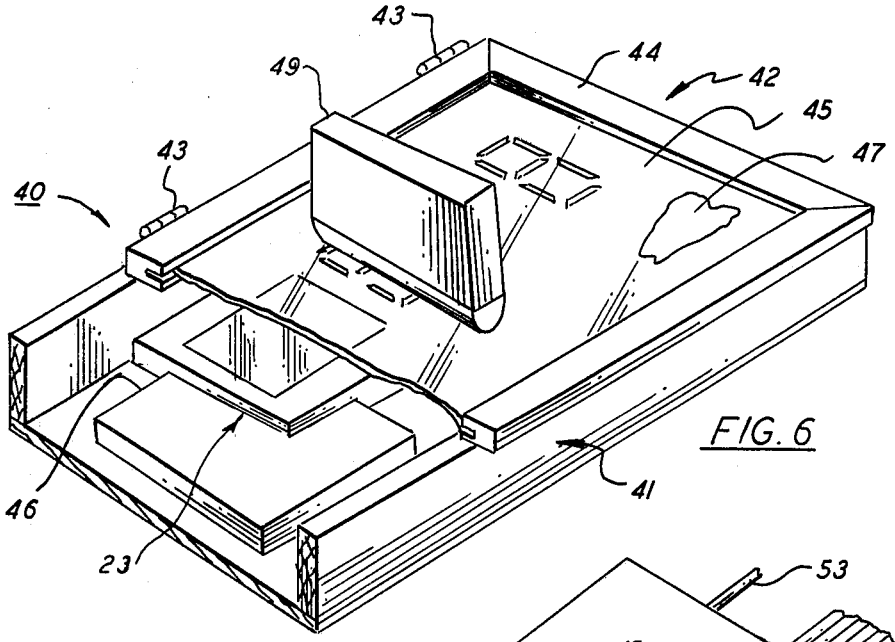
FIG. 6 is a perspective view illustrating a screening fixture for coating the marking segments of the present invention with a carbon impregnated resin.

The etched and drilled board is next placed with the front or imaging face up in a screening box 40 as illustrated in FIG. 6. The box basically contains a lower housing 41 and a screening cover 42 that is pivotably attached to the housing by means of hinges 43—43. The cover includes a rectangular frame 44 made of any suitable material and a screen 45 which is tightly mounted within the frame. The screen is of the photosensitive type used in many conventional silk screening processes. The sensitized screen is exposed through a film positive to create a porous image in the screen capable of passing finely divided materials. In the practice of the present invention, the same pattern used to generate the electrode segments on the imaging face of the marking head is photographically produced in the screen. The three digit module patterns and the composing block pattern are aligned on the screen as they appear on the face of the board. The individual segment areas that make up the patterns are made slightly longer and wider on the screen than the corresponding copper areas etched on the writing face of the board.

The etched board is seated within the housing upon a registration fixture 46 to align the copper electrode segment on the board directly beneath the porous segments formed in the screen when the cover of the housing is closed. With the cover closed, the screen is stretched tightly over the board in intimate contact therewith. An epoxy resin 47, containing finely divided particles of carbon uniformly dispersed throughout is passed back and forth over the screen pattern using a squeegee 49 or the like. Accordingly, the underlying copper segments are coated with the epoxy material. Because the screen images are slightly larger than the underlying copper segments, the epoxy mixture is caused to flow over the sides of the raised segments to completely blanket each of the segments with a uniform coating.

The board is then removed from the housing and the epoxy allowed to cure. Upon curing, the board is turned over and solder is flowed over the terminals. Sufficient solder is applied to completely fill the passages connecting the front segments to the back soldering pads.

Figure 8:
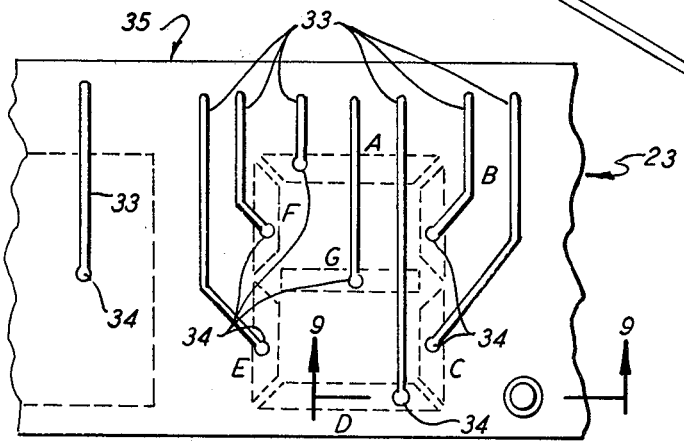
FIG. 8 is an enlarged, partial view of the back of the imaging board showing a series of terminals that are used to electrically connect each segment to a suitable power supply.

As best seen in FIGS. 7, 8 and 9, metering ports 50 are passed through the board in non-conductive areas adjacent to the digit modules and the composing block. Soldering pads 51 are provided upon the back side of the board with each pad being centered upon one of the metering ports. In assembly, short tubes 52 are inserted from the back of the board into each of the ports with care being taken to prevent the end of the tube from extending beyond the imaging face of the board. Solder is flowed onto the pad surrounding each of the tubes and the solder permitted to penetrate into the port. A secure bond is thus formed between the side wall of the port and the tube for holding the tube in place in assembly. A flexible line 53 is passed over the back end of the tube. The line is brought out of the marking head housing and attached to a supply of electrolyte. In operation the electrolyte is metered through the ports to the wicking pad via capillary action to keep the wick constantly wet.

Individual leads (not shown) are soldered to each of the segment terminals. The leads are gathered into a ribbon-like harness 57 which is brought out of the back of the marking head housing as seen in FIG. 7. In practice, the leads are connected to switching apparatus which is programmed to sequence the digit module display so that selected characters may be written on the parts being marked.

It has been found that a plain carbon electrode, which is relatively inert in regard to most electrolytes, can develop localized hot spots when a firing potential is applied thereto. The hot spots generally occur in and about the region where the input terminal is connected to the electrode. When hot spots do occur, the quality of the record mark is generally unacceptable and the part must be scrapped. As herein noted, hot spots are avoided by providing a marking electrode having a highly conductive substrate over which is placed an inert carbon coating. The highly conductive substrate serves to rapidly and evenly distribute the firing charge over the entire area of the coating. Care must be taken, however, to shield the substrate material from the receiving surface of the part. Copper and other highly conductive metals will tend to plate the surface of the receiving part when electrically charged in the presence of an electrolyte. As a consequence, the exposed substrate will be removed with repeated usage thereby causing the head to fail.

A silicone rubber binder may also be used to coat the substrate of each electrode. A rubber binder will provide a deformable blanket about the substrate material which will protect the underlying material and provide an ideal contact surface for applying the desired image. The rubber binder is again loaded with finely divided particles of carbon as described above along with particles of a more highly conductive material capable of carrying the firing charge to the surface of the electrode to enhance the quality of the produced mark. A slight pressure against the rubber will place the electrode in conforming contact against the receiving surface so that when the electrode is fired the entire image area is recorded upon the part.

While this invention has been described with reference to the structure disclosed herein, it is not confined to the details set forth and this application is intended to cover any modifications or changes as may come within the scope of the following claims.

I claim:

1. A marking head for use in an electrochemical marking process of the type wherein an electrode is fired against a receiving surface in the presence of an electrolyte to record an image upon the receiving surface, said marking head including a non-conductive board having at least one character generating module position on the front face thereof that contains a plurality of individual electrically isolated electrode segments, each of said electrode segments including a highly conductive metal substrate seated in contact against the front face of the board and a carbon coating covering the outer surface of the substrate, and electrical means connected to each individual electrode segment for independently firing the connected segment whereby the segments may be fired in different patterns to record images of selected characters upon the receiving surface.

2. The marking head of claim 1 wherein the carbon coating includes finely divided carbon particles evenly dispersed within an epoxy resin binder.

3. The marking head of claim 1 wherein the carbon coating includes finely divided carbon particles evenly dispersed within a deformable rubber binder.

4. The marking head of claim 3 that further includes conductive metal particles evenly dispersed throughout the binder.

5. The marking head of claim 1 wherein the conductive substrate of each electrode segment is formed of copper.

6. The marking head of claim 1 wherein said electrical means connected to each electrode segment includes a conductive terminal positioned upon the back face of the board and a connecting means passing through the board between the electrode segment and the terminal for placing the electrode segment in electrical communication with the terminal.

7. The marking head of claim 1 that further includes a composing block aligned with said at least one character generating module on the face of the board, said block further including a single wide area electrode containing a highly conductive substrate, a carbon coating covering the substrate and electrical means for firing said wide area electrode.

8. A marking head for use in an electrochemical marking process of the type wherein an electrode is fired against a receiving surface in the presence of an electrolyte to record an image upon the receiving surface, the marking head including a non-conductive board having a plurality of seven segment digit modules aligned upon the front face thereof for selectively generating a given number, each of said segments including a highly conductive substrate that is coated with a uniform thin layer of carbon, and electrical means for independently firing each of the segments whereby a selected multi-digit number is recorded upon the receiving surface.

9. The marking head of claim 8 wherein the substrate is formed of copper and the coating includes finely divided carbon particles evenly dispersed within an epoxy resin binder.

10. The marking head of claim 8 wherein the substrate is formed of copper and the coating includes finely divided carbon particles evenly dispersed within a deformable rubber binder.

11. The marking head of claim 10 wherein said binder further contains finely distributed conductive particles evenly dispersed therein.

* * * * *